US010234806B2

(12) United States Patent
Iwayama et al.

(10) Patent No.: US 10,234,806 B2
(45) Date of Patent: Mar. 19, 2019

(54) IMAGE FORMING APPARATUS

(71) Applicant: CANON KABUSHIKI KAISHA, Tokyo (JP)

(72) Inventors: Hiroyoshi Iwayama, Yokohama (JP); Satoshi Sunahara, Hachioji (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/892,617

(22) Filed: Feb. 9, 2018

(65) Prior Publication Data

US 2018/0239287 A1 Aug. 23, 2018

(30) Foreign Application Priority Data

Feb. 23, 2017 (JP) ..... 2017-032231
Jan. 26, 2018 (JP) ..... 2018-011614

(51) Int. Cl.

| | |
|---|---|
| ***G03G 15/00*** | (2006.01) |
| ***G03G 15/08*** | (2006.01) |
| ***G03G 15/14*** | (2006.01) |
| ***G03G 15/06*** | (2006.01) |
| ***G03G 21/00*** | (2006.01) |

(52) U.S. Cl.

CPC ..... *G03G 15/5045* (2013.01); *G03G 15/065* (2013.01); *G03G 15/0806* (2013.01); *G03G 15/0865* (2013.01); *G03G 15/14* (2013.01); *G03G 15/5037* (2013.01); *G03G 15/556* (2013.01); *G03G 21/0064* (2013.01)

(58) Field of Classification Search

CPC ..... G03G 15/5045; G03G 15/065; G03G 15/0365; G03G 15/14

See application file for complete search history.

(56) References Cited

U.S. PATENT DOCUMENTS 6,345,162 B1 * 2/2002 Ozawa ..... G03G 15/0853 399/149
9,158,231 B2 10/2015 Sunahara
9,442,454 B2 9/2016 Iwayama et al.
9,547,273 B2 1/2017 Ito et al.
9,727,002 B2 8/2017 Iwayama et al.

(Continued)

FOREIGN PATENT DOCUMENTS

JP H11-190931 A 7/1999
JP 2002-207353 A 7/2002

(Continued)

*Primary Examiner* — Hoang Ngo
(74) *Attorney, Agent, or Firm* — Venable LLP

(57) ABSTRACT

An image forming apparatus includes a photosensitive drum for bearing a developer, a charging roller that comes into contact with the photosensitive drum at a different velocity and that charges the photosensitive drum, a transfer roller that transfers a developer image on the photosensitive drum to a recording material, and a developing sleeve that supplies a developer to the photosensitive drum and that recovers a developer on the photosensitive drum after transfer. A detecting device detects information relating to injection charging, and a controller controls an amount of the fogging developer during image formation according to information detected by the detecting device while suppressing the amount of the developer recovered in the developing sleeve.

14 Claims, 5 Drawing Sheets

(56) References Cited

U.S. PATENT DOCUMENTS

| | | | | |
|---|---|---|---|---|
| 9,835,973 | B2 | 12/2017 | Goto et al. | |
| 2007/0059000 | A1* | 3/2007 | Shibuya | G03G 15/0266 399/44 |

FOREIGN PATENT DOCUMENTS

| | | | |
|---|---|---|---|
| JP | 2003-195580 | A | 7/2003 |
| JP | 2003-233253 | A | 8/2003 |
| JP | 2004-038078 | A | 2/2004 |
| JP | 2016-014863 | A | 1/2016 |

* cited by examiner

IMAGE FORMING APPARATUS

BACKGROUND OF THE INVENTION

Field of the Invention

The present invention relates to an image forming apparatus, such as a copier and a printer, which executes image formation by applying an image-forming process including a step of charging an image bearing member, such as an electrophotographic photoreceptor and an electrostatic recording dielectric, to exhibit a prescribed polarity or potential.

Description of the Related Art

Conventionally, many image forming apparatuses using an electrophotographic system adopt a process cartridge system. In a process cartridge system, a rotatable photosensitive member and processing device which act on the photosensitive member are integrated into a cartridge so as to be attachable to and detachable from an apparatus main body of an image forming apparatus.

According to the process cartridge system, since a user can personally perform maintenance of the apparatus without having to rely on service personnel, operability can be dramatically improved. Consequently, the process cartridge system is widely used in electrophotographic image forming apparatuses.

Image forming apparatuses such as a laser beam printer and a copier which adopt an electrophotographic system initially form an electrostatic latent image by irradiating a photosensitive member uniformly charged by a charging roller with light (such as laser light) corresponding to image information. Subsequently, a developer (a toner) is supplied to the electrostatic latent image by a developing apparatus to visualize the electrostatic latent image as a developer image (a toner image). Furthermore, by transferring the image from the photosensitive member to a recording material such as paper, an image is formed on the recording material and the image formed on the recording material is output.

Image forming apparatuses using such a transfer system include those which remove untransferred developer remaining on a photosensitive member after transfer from the surface of the photosensitive member using a cleaner (a cleaning apparatus) to obtain waste developer. From many aspects including environmental protection, such waste developer is desirably not produced. In consideration thereof, there is an apparatus configuration in which a cleaner is eliminated and untransferred developer on the photosensitive member after transfer is removed from the photosensitive member using a developing apparatus by "simultaneous developing and cleaning" to be collected and reused by the developing apparatus. In other words, image forming apparatuses may adopt a developer recycling process.

Simultaneous developing and cleaning refers to a method of recovering a developer remaining on a photosensitive member after transfer by a residual toner recovery bias during developing in next and subsequent steps. In other words, a fogging-removing potential difference Vback which is a difference in potential between a DC voltage applied to the developing apparatus and a surface potential of the photosensitive member is used. According to this method, since untransferred developer is recovered by the developing apparatus and reused in next and subsequent steps, waste developer can be eliminated and the trouble of maintenance can be reduced. In addition, a so-called cleaner-less image forming apparatus in which untransferred developer is recovered by a developing apparatus is also advantageous in terms of space. In other words, there is an advantage in that an image forming apparatus can be significantly downsized because there is no need to provide a cleaning apparatus.

Meanwhile, with an image recording apparatus using a contact charging member (a charging roller), the charging member that comes into contact with an image bearing member may pick up residual developer on a surface of the image bearing member and cause the residual developer to adhere to a surface of the charging member. As a result, charging performance may decline due to an amount of adhesion of the developer to the charging member as printing is repetitively performed (through repetitive operations) for a long time.

In particular, when image formation is performed with a cleaner-less image forming apparatus, untransferred developer tends to enter a charging nip portion that is a contact portion between a contact charging member and an image bearing member and, consequently, the developer adheres to the surface of the contact charging member. When the developer is present on the contact charging member, a charged potential of the image bearing member varies depending on the amount of the adhered developer. This phenomenon may appear as a fluctuation in a halftone image concentration which represents a halftone.

SUMMARY OF THE INVENTION

In order to solve such problems, a configuration is proposed in which a peripheral velocity difference is set between a contact charging member and a photosensitive member, a developer is charged by friction between the charging member and the photosensitive member, and the developer adhered to the surface of the contact charging member is returned to the photosensitive member (Japanese Patent Application Laid-open No. 2016-14863). On the other hand, with the configuration described above in which a peripheral velocity difference is set between a contact charging member and a photosensitive member, under high humidity, charging due to injection of charges to a surface of the photosensitive member inside a nip with the contact charging member may occur separately from charging due to a discharge. Such behavior of injection charging may not only create a problem in that surface potential of the photosensitive member varies in accordance with a variation in the humidity environment but may also cause adverse effects on images such as a ghost image due to an injection amount being changed by the amount of toner interposed between the photosensitive member and the charging roller.

In addition, as a known property of an injection charge component, an injection charge amount declines when a fogging developer amount on a photosensitive member increases due to a decrease in a contact area between the photosensitive member and a charging member. Therefore, in systems in which such injection charging may occur, adverse effects due to injection charging may be avoided by increasing a fogging developer amount to be supplied to a white background. However, as described above, with image forming apparatuses adopting simultaneous developing and recovery, since the fogging developer is also recovered by a developing apparatus to be reused, a problem may occur in that an increase in the fogging developer amount facilitates developer degradation.

It is an ongoing problem to be solved to suppress both adverse effects on images due to injection charging and developer degradation.

In order to achieve the object described above, an image forming apparatus according to an embodiment of the present invention is an image forming apparatus, comprising:

an image bearing member for bearing a developer;

a charging member that, in a contact portion, moves in the same direction as the image bearing member and that comes into contact with the image bearing member at a different velocity and charges the image bearing member;

transferring device for transferring a developer image on the image bearing member to a transferred body;

a developer bearing member that supplies a developer to the image bearing member and that recovers a developer remaining on the image bearing member after transfer;

detecting device for detecting information relating to injection charging in which a charge is injected to the image bearing member from the charging member; and control device for, based on the information, controlling an amount of a developer to be supplied to a non-image forming portion of the image bearing member during image formation, wherein the control device controls the amount of a developer to be supplied to a non-image forming portion of the image bearing member during image formation in accordance with information detected by the detecting device.

According to the present invention, in a configuration in which a velocity difference is set between an image bearing member and a charging member, adverse effects on images due to injection charging can be suppressed while suppressing developer degradation.

Further features of the present invention will become apparent from the following description of exemplary embodiments with reference to the attached drawings.

DESCRIPTION OF THE EMBODIMENTS

Hereinafter, a description will be given, with reference to the drawings, of embodiments of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

First Embodiment

Image Forming Apparatus and Cleaner-Less Image-Forming Process

Figure 2:
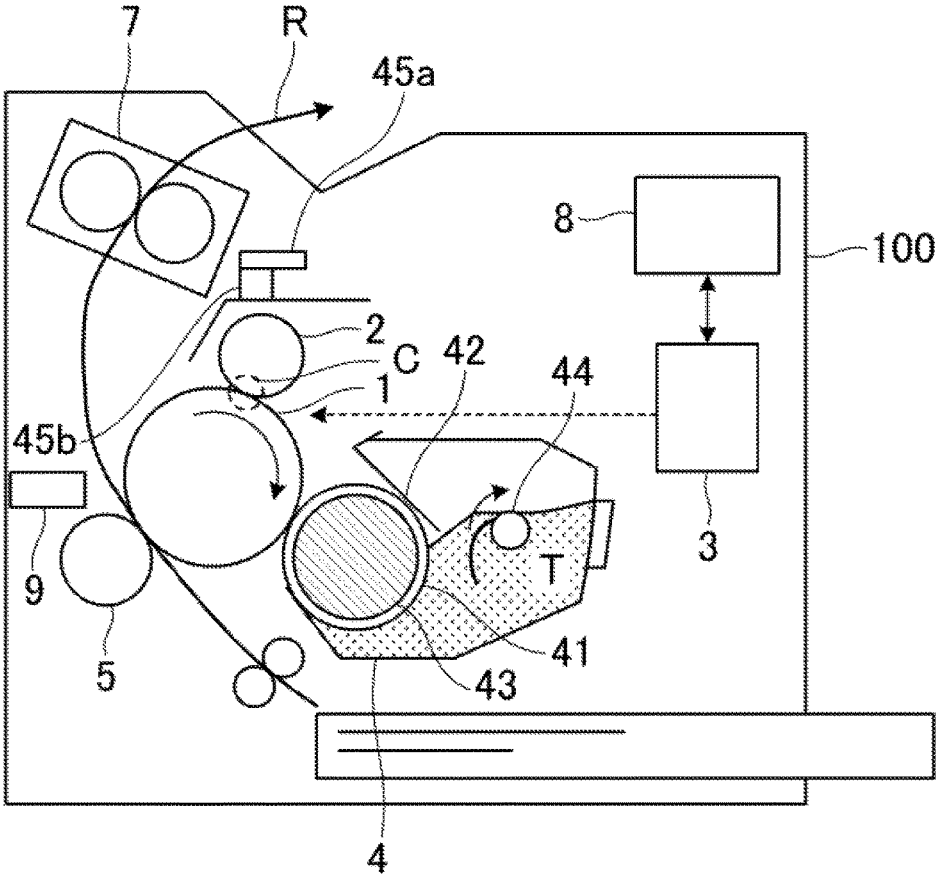
FIG. 2 is a diagram showing an image forming apparatus according to a first embodiment.

FIG. 2 is a diagram showing a schematic configuration of a printer 100 as an embodiment of an image forming apparatus according to the present invention. FIG. 2 is a sectional view as viewed along an axial direction of an image bearing member in a normal installed state. It is assumed that upward and downward on the drawing represent vertical directions and leftward and rightward represent horizontal directions.

Figure 3:
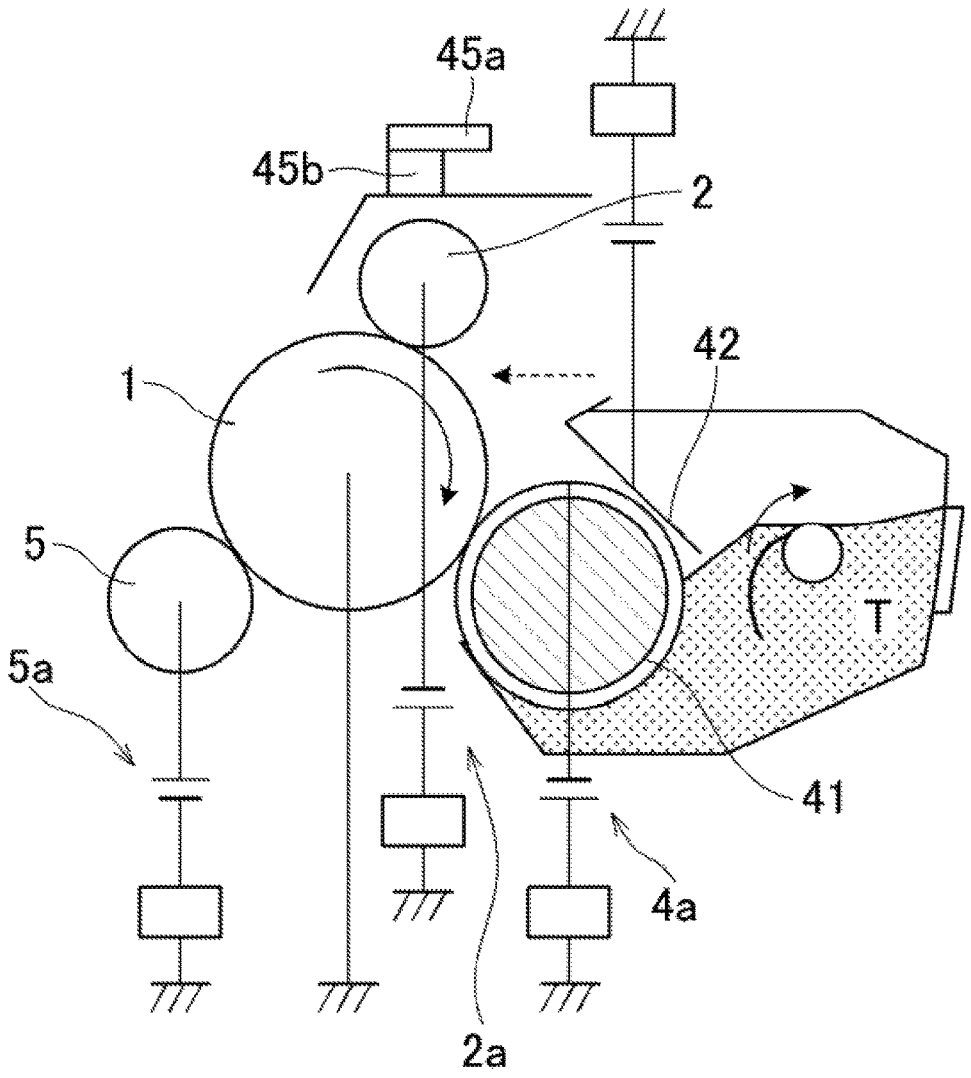
FIG. 3 is a diagram showing an enlargement of a part of an image forming apparatus according to the first embodiment.

An image forming operation will now be described with reference to FIGS. 2 and 3.

When the image forming operation is started, a photosensitive drum 1 as an image bearing member is rotationally driven at a peripheral velocity of 150 mm/sec in a direction of an arrow in FIG. 2 by a drive motor which drives the photosensitive drum 1.

A charging roller 2 is used as a charging member which charges a surface of the photosensitive drum 1. By the time the image forming operation described below starts, a process of stabilizing charged potential has already been performed. A voltage (Vpri) of −1500 V is applied to the charging roller 2 at a prescribed timing from a charging power supply 2*a* (FIG. 3) and, accordingly, a surface of a photosensitive member is uniformly charged at −800 V.

A laser exposure unit 3 as an exposing apparatus which exposes the charged photosensitive drum 1 exposes the photosensitive drum 1 using a laser beam in accordance with image data. While repetitively performing exposure in a main scanning direction (a direction of a rotational axis of the photosensitive member), the laser beam also performs exposure in a sub-scanning direction (a direction of movement of a surface of the photosensitive member) to form an electrostatic latent image.

A developing device 4 is arranged so as to be attachable to and detachable from an image forming apparatus main body and can be replaced with a new developing device 4 once its product life ends. The developing device 4 develops the electrostatic latent image formed on the photosensitive member using a developing sleeve to which a developing bias (Vdc) of −500 V has been applied from a developing bias power supply 4*a* (FIG. 3).

The developing device 4 will now be described. A developing sleeve 41 is rotatably supported by the developing device 4 and is rotationally driven at 140% peripheral velocity with respect to the photosensitive drum 1. The developing sleeve 41 includes a conductive elastic rubber layer provided around a hollow aluminum tube, and a surface of the conductive elastic rubber layer is provided with a surface roughness Ra of 1.0 μm to 2.0 μm for the purpose of transporting a developer. A magnet roller 43 which is a magnet is fixed and arranged inside the developing sleeve 41. A magnetic single-component developer (negative charging characteristics) T as a developer in the developing device 4 is stirred by a stirring member 44 in a developer container and, due to the stirring, the developer T is supplied inside the developing device 4 to a surface of the developing sleeve 41 by a magnetic force of the magnet roller 43. When the developer T supplied to the surface of the developing sleeve 41 passes through a developing blade 42 which is a regulating member that regulates a thickness of a developer layer, the developer T becomes a uniform thin layer and is charged to a negative polarity by triboelectric charging. A negative bias (Vbld) of −800 V with respect to the developing sleeve 41 is applied to the developing blade 42 to create a potential difference (ΔVbld) of −300 V with a developing roller. Subsequently, the developer T is transported to a developing position where the developing sleeve 41 comes into contact with the photosensitive drum 1 and the electrostatic latent image is developed.

A developer image visualized on the photosensitive drum 1 (on an image bearing member) is further sent to a contact portion with a transfer roller 5 as a transferring device and transferred onto a recording material R as a transferred body which is transported at a synchronized timing. A transfer bias is applied between the transfer roller 5 and the photosensitive drum 1 by a power supply 5*a* (FIG. 3). Moreover, the transferred body is not limited to the recording material described above and an intermediate transfer member such as an endless transfer belt can be adopted instead.

The recording material R onto which the developer image has been transferred is transported to a fixing apparatus 7. The recording material R is subjected to heat and pressure at the fixing apparatus 7 to fix the transferred developer image to the recording material R.

A controller 8 is a control device which controls operations of the image forming apparatus 100, and the controller 8 controls prescribed image-forming sequences and the like by controlling transmission and reception of various electric information signals, drive timings, and the like.

On the other hand, untransferred developer which remains, after transfer, on the photosensitive drum 1 without being transferred is transported toward the charging roller 2. At this point, a voltage (−1500 V) for charging the photosensitive drum 1 has been applied to the charging roller 2. When the untransferred developer is transported to the vicinity of a nip portion C, most of the untransferred developer is negatively charged together with the photosensitive drum 1 due to a discharge from the charging roller 2. In other words, since most of the untransferred developer is forcibly negatively charged, the developer passes through the charging roller 2 without adhering to the charging roller 2 due to an electric field of the charging roller 2 and the negatively-charged photosensitive drum 1. Although most of the developer is negatively charged by the discharge from the charging roller 2 as described above, a small amount of the developer which had not been negatively charged remains and may adhere to the charging roller 2. In order to reduce such developer adhesion, the charging roller 2 is provided so as to rotate at a 110% peripheral velocity in a same direction with respect to the photosensitive drum 1 using a gear, which means that the charging roller 2 is provided with a higher peripheral velocity than the photosensitive drum 1. In other words, a configuration is adopted in which the charging roller 2 comes into contact with the photosensitive drum 1 at a different velocity. In this case, at the nip portion C which is a contact portion, the surface of the photosensitive drum 1 and the surface of the charging roller 2 rotate in a same direction. Accordingly, the developer is negatively charged by friction between the charging roller 2 and the photosensitive drum 1 and the developer is returned to the photosensitive drum 1 by an electric field. The peripheral velocity of the charging roller 2 is favorably 110% to 140% of the peripheral velocity of the photosensitive drum 1. Accordingly, the amount of the developer which adheres to the charging roller 2 is reduced due to negative charging of the developer by a discharge from the charging roller 2 and negative charging by friction caused by the peripheral velocity difference.

The untransferred developer having passed through the charging roller 2 is subsequently transported to a developing position with a rotation of the photosensitive drum 1. In this state, in a non-image forming portion, there is a potential difference (Vback) of −300 V between a dark portion potential (Vd) of −800 V of the surface of the photosensitive drum 1 and the developing bias (Vdc) of −500 V. As a result, the untransferred developer adheres to the developing sleeve 41 to be recovered in the developing device 4. This is referred to as simultaneous developing and cleaning. In this case, the developing sleeve 41 constitutes a developer bearing member which supplies the developer to the photosensitive drum 1 and which recovers the developer remaining on the photosensitive drum 1 after transfer. In an image forming portion, the untransferred developer does not adhere to the developing sleeve 41 due to an electric field between a light portion potential (Vl) of −100 V of the surface of the photosensitive drum 1 and the developing bias (Vdc) of −500 V. However, since the portion is where image formation is to be performed, the developer remains on the photosensitive drum 1 to be subsequently transferred. An image forming operation is executed by repeating such steps.

Figure 1:
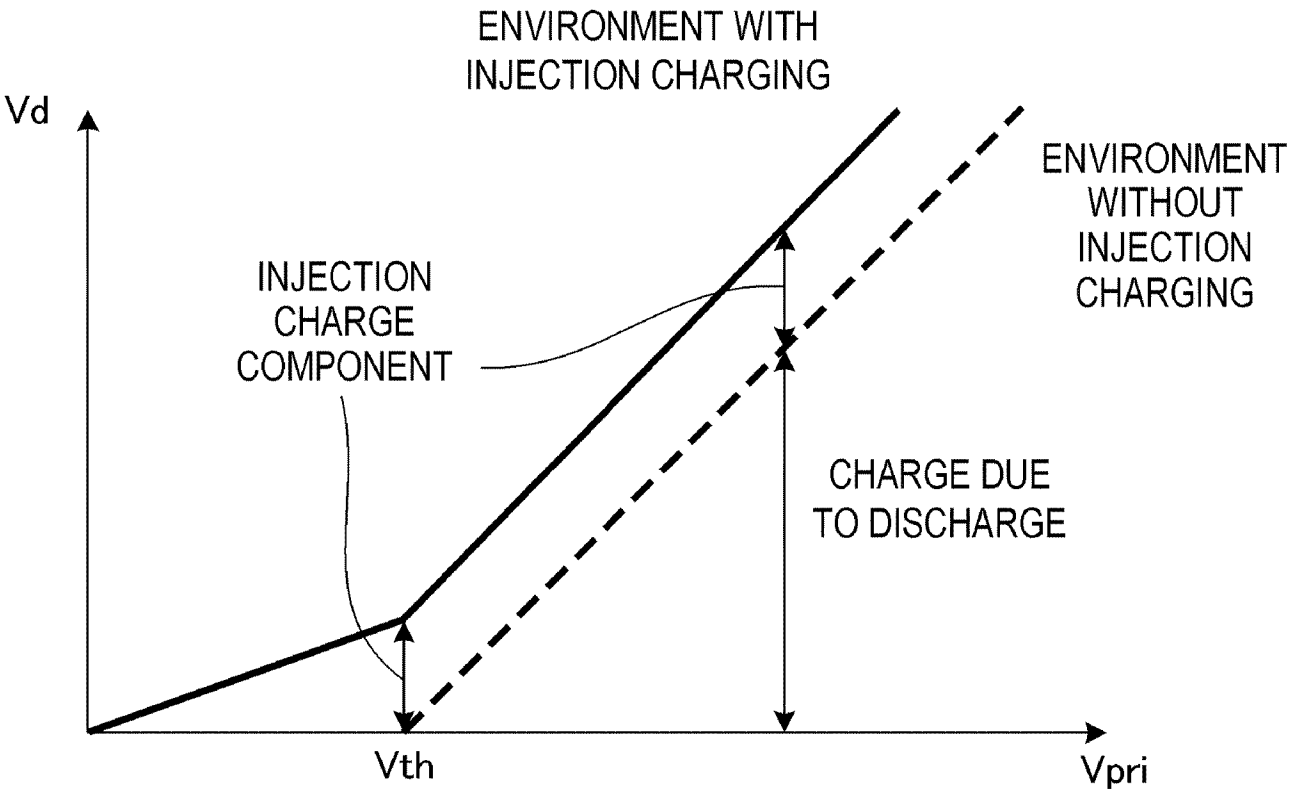
FIG. 1 is a diagram showing injection charging which is a problem addressed by the present invention.

In a configuration in which a peripheral velocity difference is set between the charging roller 2 and the photosensitive drum 1, as shown in FIG. 1, charging of the dark portion potential of the surface of the photosensitive drum 1 may occur not only due to a discharge but also due to injection of charges to the photosensitive drum 1 particularly under high humidity. Such behavior of injection charging may not only create a problem in that surface potential of the photosensitive drum 1 varies in accordance with a variation in the humidity environment but also cause adverse effects on images such as a ghost image due to an injection amount being changed by the amount of the developer interposed between the photosensitive drum 1 and the charging roller 2.

Configuration of Present Embodiment

In consideration thereof, a feature of the present embodiment is that a developing bias is controlled such that, under temperature and humidity conditions in which injection charging described above may occur, the amount of a fogging developer that is the developer to be supplied to a non-image forming portion (white background) of the photosensitive drum 1 is increased. Therefore, in the present embodiment, temperature and humidity of the vicinity of a charging apparatus must be detected as environmental information in the vicinity of an image bearing member and, accordingly, a temperature/humidity sensor 9 is mounted to the apparatus main body. Humidity is not limited to relative humidity and absolute humidity or an absolute moisture content can be adopted instead. In the case of the configuration of the present embodiment described above, an injection charge component was generated in a high temperature, high humidity environment as shown in Table 1.

TABLE 1

Temperature/humidity and injection charge amount

| | Humidity | | | | |
|---|---|---|---|---|---|
| Temperature | 5% | 25% | 55% | 75% | 95% |
| 40 degrees | 0 V | 0 V | 10 V | 20 V | 30 V |
| 30 degrees | 0 V | 0 V | 0 V | 0 V | 10 V |
| 10 degrees | 0 V | 0 V | 0 V | 0 V | 0 V |

Figure 4:
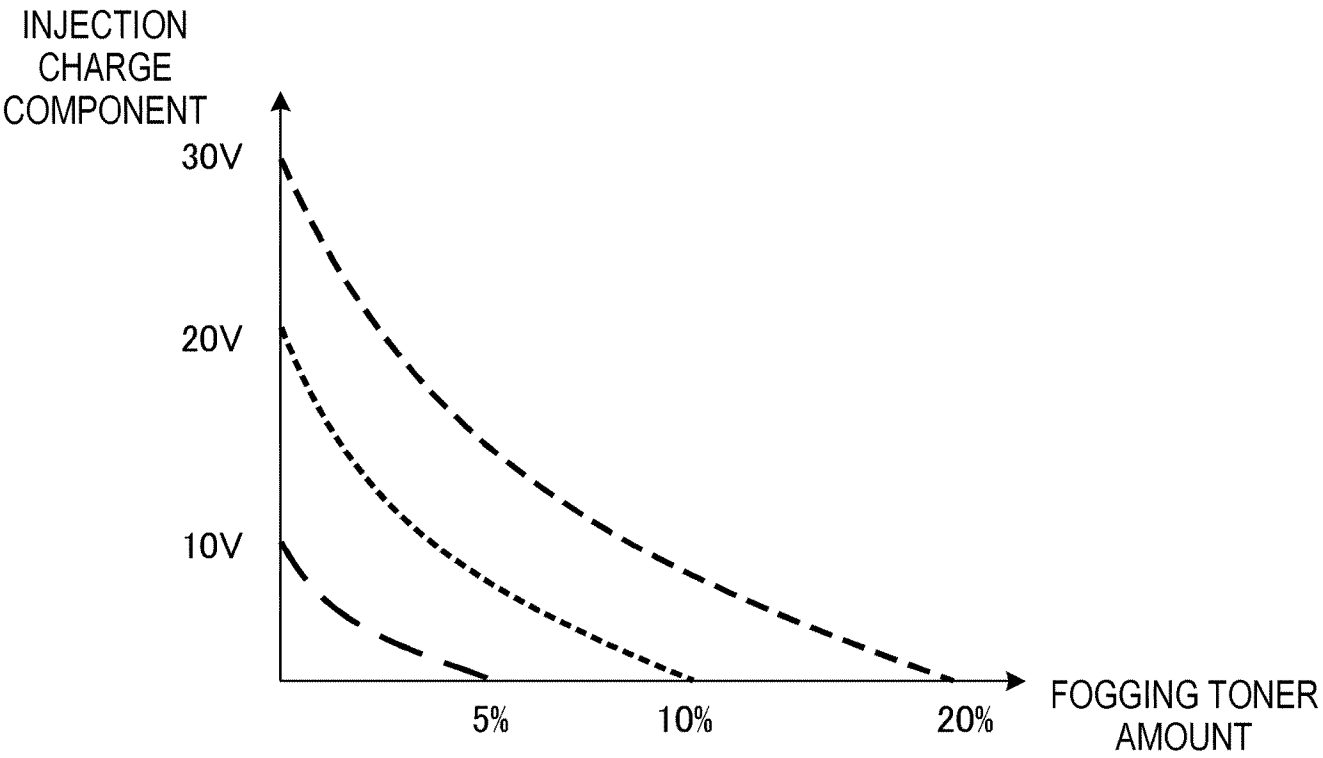
FIG. 4 is a diagram representing a relationship between a fogging toner amount and injection charging.
Figure 5:
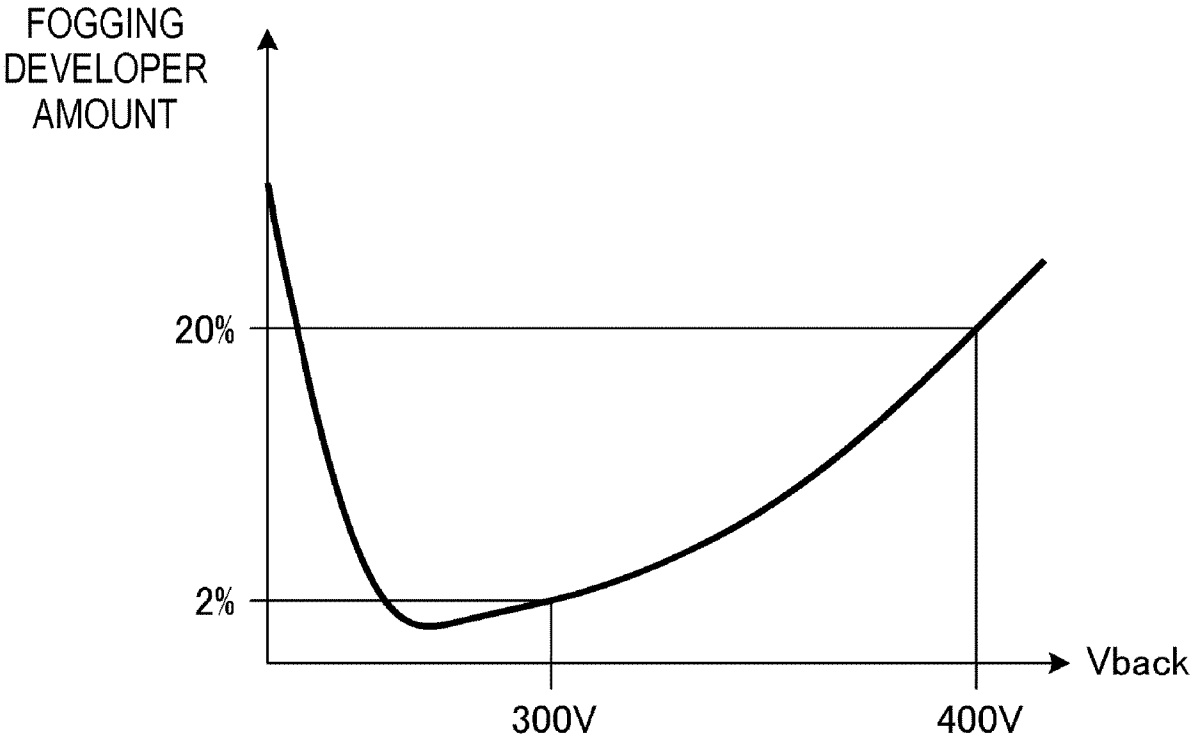
FIG. 5 is a diagram representing a relationship between a fogging developer amount and a fogging-removing potential difference Vback.

As described earlier, a known characteristic of an injection charge component is that an injection charge amount decreases as a fogging developer amount increases. In the present embodiment, a relationship between an injection charge component and a fogging toner amount was as shown in FIG. 4. Therefore, for example, an injection charge component 30 V in an environment of 40 degrees and 95% humidity can be eliminated if the fogging developer amount on the photosensitive drum 1 is 20%. On the other hand, as shown in FIG. 5, the fogging developer amount has a significant correlation with the fogging-removing potential difference Vback. In the present embodiment, the fogging developer amount on the photosensitive drum 1 during normal image formation described earlier was around 2% in all temperature and humidity ranges when Vback during normal image formation is −300 V. In consideration thereof, the developing bias (Vdc) applied to the developing sleeve 41 was changed from the usual −500 V by Δ100 V to −400 V. The difference (Vback) between the dark portion potential (Vd) of −800 V of the surface of the photosensitive drum 1 and the developing bias (Vdc) of −400 V becomes −400 V. As a result, the fogging developer increased to 20% and the injection charge component in the environment of temperature of 40 degrees and 95% humidity was eliminated. Therefore, while the developing bias described above may be applied to all environments, an increase in the fogging developer amount may facilitate deterioration of the developer in an image forming apparatus adopting simultaneous developing and recovery. Accordingly, the amount of the fogging developer is desirably controlled to a minimum.

In consideration thereof, in the present embodiment, the bias control shown in Table 2 was performed in order to eliminate the injection charge component shown in Table 1. Specifically, control is performed so as to change the developing bias in accordance with temperature and humidity detected by the temperature/humidity sensor 9 while suppressing the amount of the developer recovered in the developing device 4 by causing the developer to adhere to the developing sleeve 41. More specifically, when both temperature and humidity detected by the temperature/humidity sensor 9 increase, the developing bias is changed so that the amount of the fogging developer increases.

TABLE 2

| Developing bias change control | | | | | |
|---|---|---|---|---|---|
| | Humidity | | | | |
| Temperature | 5% or more | 25% or more | 55% or more | 75% or more | 95% or more |
| 40 degrees or more | — | — | +50 V | +75 V | +100 V |
| 30 degrees or more | — | — | — | — | +50 V |
| 10 degrees or more | — | — | — | — | — |

In the present embodiment, as storage device, a memory 45*a* is provided in the apparatus main body and a memory 45*b* is provided in a charging apparatus, and data can be written into and read from the memories as needed. A nonvolatile memory is capable of holding stored data even when power of the main body is turned off. In the present embodiment, the nonvolatile memory 45*b* stores, as information, control values of a developing bias at the temperature and humidity shown in Table 2 described above and the bias information is stored in the main body memory 45*a* when power of the main body is turned on or upon standby. In other words, first control information which associates temperature and humidity with a developing bias is stored in the memory 45*b* as the first storage device. In addition, a temperature/humidity sensor which detects temperature and humidity around the charging apparatus is installed in the image forming apparatus main body. These two pieces of information enable control of the developing bias which is necessary to eliminate an injection charge amount of the charging apparatus. In the present embodiment, the developing bias is controlled every time a print signal is sent to the apparatus main body, in which case the developing bias shown in Table 2 is determined according to temperature/humidity information at that time point.

A feature of the present embodiment is that, in this manner, the developing bias is changed so as increase a fogging developer based on information from a temperature/humidity sensor installed in the image forming apparatus main body and values of an injection charge component under respective environments which are stored in a memory in advance. Performing the control according to the present embodiment enables injection charging in a required environment to be eliminated in an optimal manner and, by extension, adverse effects of injection charging on images can be suppressed.

Modification

While an optimal fogging developer amount for eliminating an injection charge component is controlled by changing a developing bias in the present embodiment, any means may be used as long as the fogging developer amount can be controlled.

For example, the fogging developer can be increased by reducing an absolute value of a difference (a regulating member bias) ΔVbld in applied biases to the developing blade 42 and the developing sleeve 41. An injection charge component can be controlled even with this method, and in the case of the present modification, Table 2 described above can be changed as shown in Table 3. Specifically, by changing the potential ΔVbld between the developing sleeve 41 and the developing blade 42, the amount of the fogging developer can be controlled.

Even in the present modification, second control information which associates temperature and humidity with the potential ΔVbld between the developing sleeve 41 and the developing blade 42 may be stored in the memory 45*b* as the second storage device.

TABLE 3

| Developing blade bias change control | | | | | |
|---|---|---|---|---|---|
| | Humidity | | | | |
| Temperature | 5% or more | 25% or more | 55% or more | 75% or more | 95% or more |
| 40 degrees or more | — | — | +100 V | +150V | +300 V |
| 30 degrees or more | — | — | — | — | +100 V |
| 10 degrees or more | — | — | — | — | — |

Second Embodiment

In the present embodiment, an injection charge component is measured and controlled.

As shown in FIG. 1, the injection charge component can be measured when a discharge start voltage (Vth) or, in the present embodiment, 600 V is applied to the charging roller 2 as a bias (Vpri). Measurement methods include measuring a surface potential of a photosensitive drum using a surface potentiometer installed in the apparatus main body and measuring a value of a current flowing through the charging roller using a galvanometer. In the present embodiment, a time for measurement is provided during a forward rotation using a surface potentiometer installed in the apparatus main body. Specifically, control is performed so as to change the developing bias in accordance with an injection charge component detected by a surface potentiometer or a galvanometer while suppressing the amount of the developer recovered in the developing device 4 by causing the developer to adhere to the developing sleeve 41. More specifically, when injection charge component increase, the developing bias is changed so that the amount of the fogging developer increases. In addition, as demonstrated in the modification of the first embodiment, the amount of the fogging developer may be controlled by changing the potential ΔVbld between the developing sleeve 41 and the developing blade 42.

In this case, unlike the first embodiment, there is no need to mount the temperature/humidity sensor 9 to the image forming apparatus main body. In the present embodiment, data for developing bias control shown in Table 4 is stored in the memory 45*a* as storage device and an amount of feedback to the developing bias is directly controlled based on a measured injection charge amount. In other words, third control information which associates an injection charge component (an injection charge amount) with developing bias is stored in the memory 45*a* as the third storage device. In addition, as demonstrated in the modification of the first embodiment, fourth control information which associates an injection charge component (an injection charge amount) with the potential ΔVbld between the developing sleeve 41 and the developing blade 42 may be stored in the memory 45*a* as the fourth storage device.

TABLE 4

| Injection charge amount and developing bias control | | | | |
|---|---|---|---|---|
| Injection charge amount | 0 V or more | 10 V or more | 20 V or more | 30 V or more |
| Developing bias control | N/A | +50 V | +70 V | +100 V |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefits of Japanese Patent Application No. 2017-032231, filed on Feb. 23, 2017 and Japanese Patent Application No. 2018-011614, filed on Jan. 26, 2018 which are hereby incorporated by reference herein in its entirety.

What is claimed is:

1. An image forming apparatus, comprising:

an image bearing member for bearing a developer;

a charging member that, in a contact portion, moves in the same direction as the image bearing member and that comes into contact with the image bearing member at a different velocity and charges the image bearing member;

a transferring device for transferring a developer image on the image bearing member to a transferred body;

a developer bearing member that supplies a developer to the image bearing member and that recovers a developer remaining on the image bearing member after transfer;

a detecting device for detecting information relating to injection charging in which a charge is injected to the image bearing member from the charging member; and a control device for, based on the information, controlling an amount of a developer to be supplied to a non-image forming portion of the image bearing member during image formation.

2. The image forming apparatus according to claim 1, wherein information detected by the detecting device is environmental information including at least any of absolute humidity, relative humidity, and an absolute moisture content, and temperature, of the vicinity of the image bearing member, and the control device performs control so that the amount of a developer supplied to a non-image forming portion of the image bearing member during image formation increases when at least any of absolute humidity, relative humidity, and an absolute moisture content, and temperature, of the vicinity of the image bearing member increase all together.

3. The image forming apparatus according to claim 2, wherein the control device changes a developing bias applied to the developer bearing member so that an absolute value of the developing bias decreases when at least any of absolute humidity, relative humidity, and an absolute moisture content, and temperature, of the vicinity of the image bearing member increase all together.

4. The image forming apparatus according to claim 2, comprising a regulating member that regulates a developer borne by the developer bearing member, wherein regulating member bias with respect to the developer bearing member is applied to the regulating member, and the control device changes the regulating member bias so that an absolute value of the regulating member bias decreases when at least any of absolute humidity, relative humidity, and an absolute moisture content, and temperature, of the vicinity of the image bearing member increase all together.

5. The image forming apparatus according to claim 4, further comprising a second storage device for storing second control information associating information, detected by the detecting device, with the regulating member bias, wherein the control device changes a potential between the developer bearing member and the regulating member, based on the second control information stored in the second storage device.

6. The image forming apparatus according to claim 1, further comprising a first storage device for storing first control information associating information, detected by the detecting device, with the developing bias, wherein the control device controls a developing bias applied to the developer bearing member, based on the first control information stored in the first storage device.

7. The image forming apparatus according to claim 1, wherein information detected by the detecting device is an injection charge component in a potential of the image bearing member.

8. The image forming apparatus according to claim 7, wherein the control device performs control so that the amount of a developer supplied to a non-image forming portion of the image bearing member during image formation increases when injection charge component increase.

9. The image forming apparatus according to claim 8, wherein the control device changes a developing bias applied to the developer bearing member so that an absolute value of the developing bias decreases when injection charge component increase.

10. The image forming apparatus according to claim 9, further comprising a third storage device for storing third control information associating the injection charge component with the developing bias, wherein the control device controls the developing bias, based on the third control information stored in the third storage device.

11. The image forming apparatus according to claim 8, further comprising a regulating member that regulates a developer borne by the developer bearing member, wherein regulating member bias with respect to the developer bearing member is applied to the regulating member, and the control device changes the regulating member bias so that an absolute value of the regulating member bias decreases when injection charge component increase.

12. The image forming apparatus according to claim 11, further comprising a fourth storage device for storing fourth control information associating the injection charge component with the regulating member bias, wherein the control device controls the regulating member bias, based on the fourth control information stored in the fourth storage device.

13. The image forming apparatus according to claim 1, wherein the transferred body is a recording material.

14. The image forming apparatus according to claim 1, wherein the transferred body is an intermediate transfer member.

* * * * *